US007992679B2

(12) United States Patent
Geens

(10) Patent No.: US 7,992,679 B2
(45) Date of Patent: Aug. 9, 2011

(54) ANCHOR SYSTEM FOR PERSONAL BELAY SAFETY LINES

(75) Inventor: Stefaan Geens, Edegem (BE); Frank Wijckmans, legal representative, Zaventem (BE)

(73) Assignee: Exponent Challenge Technology (BE)

( * ) Notice: Subject to any disclaimer, the term of this patent is extended or adjusted under 35 U.S.C. 154(b) by 1457 days.

(21) Appl. No.: 11/451,808

(22) Filed: Jun. 13, 2006

(65) Prior Publication Data

US 2007/0017740 A1 Jan. 25, 2007

(30) Foreign Application Priority Data

Jun. 14, 2005 (BE) ..... 2005/0302

(51) Int. Cl.
*A47L 3/04* (2006.01)

(52) U.S. Cl. ..... 182/3; 182/36; 104/115

(58) Field of Classification Search ..... 104/112, 104/113, 115, 117; 182/3, 36
See application file for complete search history.

(56) References Cited

U.S. PATENT DOCUMENTS 4,790,410 A * 12/1988 Sharp et al. ..... 182/36
5,050,704 A 9/1991 Olsson
5,224,427 A * 7/1993 Riches et al. ..... 104/115
5,279,385 A 1/1994 Riches et al.
5,287,950 A 2/1994 Feathers et al.
5,297,651 A * 3/1994 Vandelinde ..... 182/3
5,343,975 A 9/1994 Riches et al.
5,351,906 A 10/1994 Feathers
5,447,280 A 9/1995 Feathers
5,722,612 A 3/1998 Feathers
5,979,599 A * 11/1999 Noles ..... 182/36
6,032,758 A 3/2000 May
6,056,085 A * 5/2000 Cutter et al. ..... 182/36
6,158,548 A 12/2000 May
6,227,329 B1 5/2001 Ador
6,260,661 B1 * 7/2001 Cutter et al. ..... 182/45
6,279,682 B1 8/2001 Feathers
6,298,629 B1 * 10/2001 Ador ..... 52/698
6,330,861 B1 * 12/2001 Flux ..... 104/115
6,354,399 B1 3/2002 Austin
6,378,465 B1 4/2002 Austin
6,446,753 B1 9/2002 Novak
6,478,112 B2 11/2002 Lee
6,484,372 B2 11/2002 Novak et al.
6,488,118 B1 * 12/2002 Corriveau ..... 182/36

(Continued)

FOREIGN PATENT DOCUMENTS

EP 0 608 168 6/1994

(Continued)

*Primary Examiner* — S. Joseph Morano
*Assistant Examiner* — Jason C Smith
(74) *Attorney, Agent, or Firm* — Maginot, Moore & Beck, LLP

(57) ABSTRACT

An anchor system for a personal fall protection system having belay lines extending between vertical supports includes modular components adapted to be mounted to virtually any structure while permitting the installation of one or two belay line runs. A mounting plate interfaces with the vertical support, while one or two support plates are supported by the mounting plate and by anchor elements extending through each of the plates. Each support plate includes a shuttle guide and is configured to connect to belay line segments running between successive anchor systems and forming the complete belay line course. The fall protection system is further provided with a transfer station that allows a person to transfer from one belay line to another.

28 Claims, 10 Drawing Sheets

U.S. PATENT DOCUMENTS

| | | | | |
|---|---|---|---|---|
| 6,491,135 | B2 | 12/2002 | Lee | |
| 6,604,605 | B2 * | 8/2003 | Peterson et al. | 182/36 |
| 6,622,350 | B2 | 9/2003 | Austin et al. | |
| 6,640,727 | B2 * | 11/2003 | Ostrobrod | 104/91 |
| 6,736,239 | B2 * | 5/2004 | Peterson et al. | 182/36 |
| 6,802,390 | B2 * | 10/2004 | Peterson et al. | 182/36 |
| 6,902,031 | B2 | 6/2005 | Ador | |
| 2003/0029672 | A1 * | 2/2003 | Argoud | 182/36 |
| 2003/0192739 | A1 * | 10/2003 | Peterson et al. | 182/36 |
| 2003/0192740 | A1 * | 10/2003 | Peterson et al. | 182/36 |
| 2004/0211622 | A1 * | 10/2004 | Renton et al. | 182/3 |
| 2006/0090960 | A1 * | 5/2006 | Liggett | 182/36 |
| 2007/0017740 | A1 * | 1/2007 | Geens et al. | 182/3 |
| 2007/0119653 | A1 * | 5/2007 | Brown et al. | 182/36 |
| 2010/0108440 | A1 * | 5/2010 | Maes et al. | 182/3 |
| 2010/0230207 | A1 * | 9/2010 | Larson et al. | 182/5 |

FOREIGN PATENT DOCUMENTS

| | | | |
|---|---|---|---|
| EP | 1500755 | A1 | 1/2005 |
| WO | WO9826842 | A1 | 6/1998 |
| WO | WO 03/039681 | | 5/2003 |
| WO | WO03039681 | A1 | 5/2003 |

* cited by examiner

ANCHOR SYSTEM FOR PERSONAL BELAY SAFETY LINES

BACKGROUND OF THE INVENTION

The present invention relates to personal continuous belay systems for use with a suspended belay line system. In particular, the invention concerns a modular system for anchoring the suspended belay line system in a manner that easily accommodates the personal belay system.

In a typical personal belay system, the user is fitted with a harness that may be removably clipped to a shuttle or glider. The shuttle is configured to slide easily along an array of belay lines in the form of suspended ropes or cables. Common forms of personal belay systems are used in the construction and building maintenance industries where workers are performing tasks at dangerous heights, such as high-rise building construction, window washing and roof repairs. In these common systems, the runs are relatively short and often include a cable run dedicated to each worker. Moreover, the cable runs are usually fixed, stable and predictable. For instance, in building construction, the runs follow existing horizontal beams of the building and are anchored to the building vertical beams.

Personal belay systems are also finding increasing use in the recreation and adventure market. Fall arresting systems are essential gear for mountain climbing, rock climbing and rappelling. More recently, fall arrest systems have been used in obstacle and adventure courses in which a participant must negotiate a hazardous and unstable course. Such a course may include an elevated "trail" formed by horizontal ropes, suspended logs, rocks and the like. In these adventure courses, the personal belay system must provide security against an accidental fall, without inhibiting the participant's freedom of movement.

Unlike the commercial and industrial uses noted above, the belay system in the adventure course contemplates long belay line runs and an extremely active participant. In some adventure courses, the participant's travel through the course is timed, so the adventurer will necessarily be moving as fast as possible. The belay system must not interfere with the rapid traverse of the adventurer and must be flexible enough to work wherever the adventure course may go. In some course, multiple participants may be traversing the same run at the same time, so the belay system must be able to accommodate multiple safety cables/ropes and multiple shuttles/gliders.

As participants demand more and more excitement, the adventure course will increase in complexity and risk. There is a need for a modular continuous belay system that can grow with the adventure course while providing the greatest degree of flexibility and usability possible.

SUMMARY OF THE INVENTION

In view of this need, the present invention contemplates an anchor system for use with a personal belay line safety system. The present anchor system contemplates a modular system with components that can be used on a wide range of vertical supports and to form a wide range of belay line runs. One component of the modular system is a mounting plate that is configured to be mounted to a support, such as a tree or a post. In one feature, the mounting plate is provided with a row of holes for receiving anchor elements therethrough. In another feature, the mounting plate is provided with an arrangement of slots configured to receive a band or strap that encircles the vertical support.

The mounting plate includes a plurality of slots for receiving adjustable spacers. The spacers are configured to contact the vertical support when the mounting plate is mounted to the support by the anchor elements. The spacers may be adjusted to account for variations in the surface of the vertical support to ensure that the mounting plate maintains a stable and accurate orientation.

Each mounting plate supports one or more support plates, each support plate carrying a shuttle guide. The shuttle guide is adapted for slidable passage of a shuttle that is part of the user's personal fall arrest system. The shuttle guide also forms part of the belay line run, and in particular is configured to engage segments of the line that are combined to form the entire run. Thus, in a further aspect of the invention, the shuttle guides include a tubular body with internal threads at its opposite ends. A profile tip is provided for each end in which the profile tip includes a threaded stem for engagement with the internal threaded ends of the tubular body. The profile tip is hollow so that a portion of a segment of the belay line may extend through the tip with the end of the segment disposed within the body.

A ferrule or similar element is affixed to the end of the segment thereby trapping the profile tip on the end of the belay line segment. When the profile tip is threaded into the tubular body, the segment is fastened to the body, and ultimately to the support plate of the anchor system. This feature of the invention allows a complete belay line run to be formed by coupling segments of the run to the ends of a shuttle guide. This feature eliminates the problems associated with using a single continuous rope or cable to form the belay line run. This feature firmly anchors each end of the belay line segment to a particular anchor system. Moreover, a particular segment may be easily replaced by removing the profile tips at the ends of the segment from the corresponding shuttle guide. Not only does this feature simply replacement of a damaged rope or cable, it also allows for quick modification to the belay line course.

In one embodiment of the invention, the anchor elements are in the form of threaded rods having a length sufficient to pass through the vertical support as well as the openings in the mounting plate and corresponding openings in the support plates. The anchor elements not only function to anchor the mounting plate to the vertical support, they also fix the support plates, and their associated shuttle guides and cable segments, to the mounting plate. Thus, in one embodiment, an arrangement of threaded nuts is used to clamp the one or more support plates to at least two threaded rod anchor elements. In order to maintain spacing between the shuttle guides a belay line segments when two belay line runs are being anchored, tubular spacers are placed between the two support plates with the anchor elements passing through the spacers.

In a further feature of the invention, the mounting plate and support plates are provided with at least four openings or holes for receiving an anchor element, such as the threaded rod. For any given anchor system, only two anchor elements are usually necessary, which means that only two of the four holes are used to mount the plates to the anchor elements. This feature allows two like configured anchor systems to be mounted on a single vertical support. Thus, one pair of anchor elements extend through two of the four holes in one anchor system, while another pair of anchor elements extends through a different set of two holes. In this way, the anchor elements do not interfere with each other when passing through the vertical support.

The present invention thus contemplates that the modular mounting plate and support plate constructions allow for at least two anchors on one vertical support, such as might be needed when the belay line run traverses a corner. If the vertical support has a large enough circumference, each mounting plate will occupy its own dedicated extent of that circumference. However, if the vertical support has a smaller circumference, the modular mounting plates of the present invention are still able to accommodate mounting two anchor systems to the single vertical support. Thus, according to a further aspect of the invention, the mounting plate includes side wings that are adapted to overlap between adjacent mounting plates. A common adjustable spacer may be used to couple the overlapping side wings of the adjacent mounting plates together, while still performing its space filling function.

In another aspect of the invention the fall protection system is provided with an optional unidirectional tip for engagement to selected shuttle guides. In one embodiment, the profile tip comprises an engagement end configured for removable engagement with an end of a shuttle guide opposite the end of the guide that is connected to the belay line, and a body extending from the engagement end. The profile tip is further provided with a deflectable unidirectional element mounted to the body, wherein the element is configured to prevent passage of a shuttle over the body in one direction and deflectable to permit passage of the shuttle over the body in the opposite direction. In certain embodiments, the element is a torsion spring having opposite arms projecting outward from the body. The hub of the torsion spring may be anchored within a slot formed in the profile tip body. The torsion spring is configured so that the arms deflect toward the body to permit passage of the shuttle.

The present invention further contemplates a transfer station for use with a personal fall protection system having multiple belay lines converging on a single vertical support. The transfer station allows the user or participant to transfer his/her shuttle between different belay line runs. In one embodiment, the transfer station comprises a mounting plate and anchor elements configured to fasten the mounting plate to the vertical support, and at least two shuttle guides carried by the mounting plate. Each shuttle guide is configured to slidably receive a shuttle thereon, with one end of each shuttle guide being connectable to a different belay line terminating at the transfer station. The station further comprises a transfer shuttle guide configured to slidably receive a shuttle thereon. The transfer shuttle guide is rotatably supported on the mounting plate so that the transfer shuttle guide may be rotated into alignment with any of the shuttle guides for passage of a shuttle therebetween.

In one embodiment, one of the shuttle guides is fastened to the mounting plate generally tangential to the vertical support, while another shuttle guide is supported substantially perpendicular to the vertical support. In this embodiment, the transfer shuttle guide is rotatably supported to be rotated into alignment the one or another of these shuttle guides. In a further embodiment, an additional shuttle guide is mounted tangential to the vertical support but angularly offset from the first mention shuttle guide. The user/participant thus has a choice between moving from one shuttle guide associated with one belay line run to one of two other shuttle guides and two other belay line runs.

In one embodiment, the transfer shuttle guide is mounted within a barrel that is rotatably supported by the mounting plate. In another embodiment, a rotating transfer ring is supported by a circumferential beam that encircles the vertical support. In this alternative embodiment, the transfer ring may carry multiple transfer shuttle guides that may be rotated into alignment with any of a plurality of belay line terminus shuttle guides extending perpendicular to the vertical support.

It is one object to of the invention to provide an anchor system that is modular, meaning that the components of the system may be mixed and matched as necessary for a particular belay line arrangement. Another object is to provide an anchor system of common components that are adapted to be supported on a wide range of vertical supports, whether the supports are walls, trees, or the like.

Another object is to provide an anchor system that can be easily installed and even re-configured without removing the anchoring components from the vertical supports. These and other objects and benefits of the invention will become apparent upon consideration of the following written description and accompanying figures.

DESCRIPTION OF EMBODIMENTS OF THE INVENTION

Figure 1:
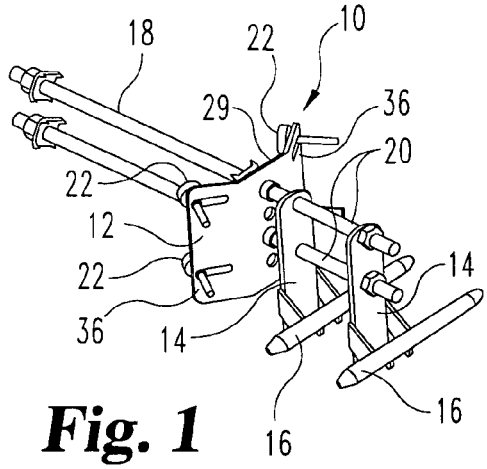
FIG. 1 is a perspective view of a fall protection anchor system according to one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
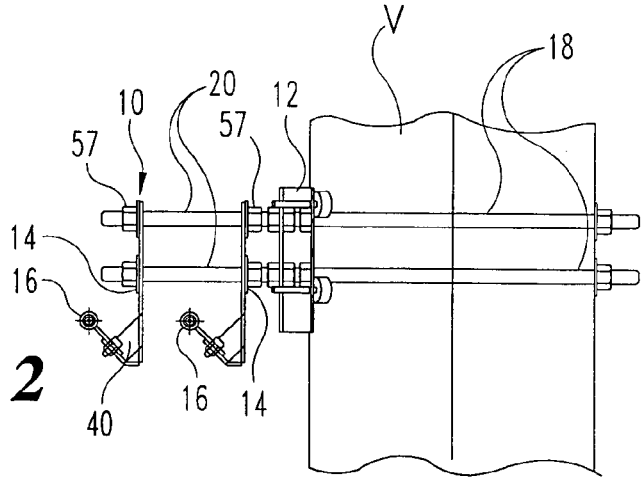
FIG. 2 is a side view of the fall protection anchor system shown in FIG. 1, with the system fastened to a vertical support.
Figure 3:
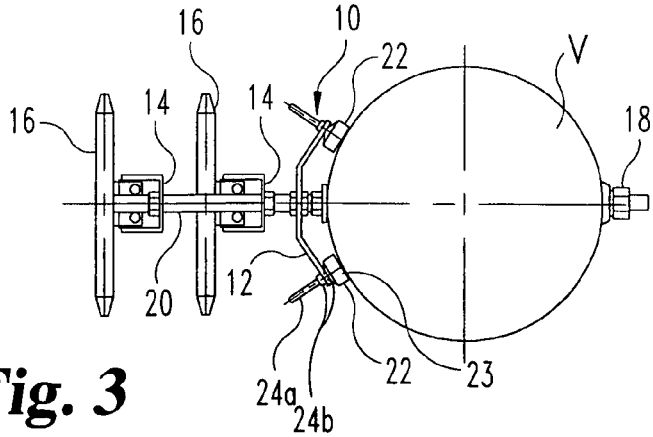
FIG. 3 is a top view of the fall protection anchor system shown in FIG. 2.

The present invention contemplates an anchor system for use with a continuous personal belay and fall arresting system. In one aspect of the invention, an anchor system 10, shown in FIGS. 1-3, is provided that is configured to be anchored to a vertical element, such as a tree, pole or wall. The anchor system includes a mounting plate 12 that is configured in the illustrated embodiment to engage a generally cylindrical vertical support. A support plate 14 is provided for each belay line belay line that is to be supported by the system 10. Each support plate carries a corresponding shuttle guide 14 that is configured to accept a shuttle or glider sliding thereon. In accordance with the present invention, the shuttle guide is also configured to support belay line segments, as described in more detail herein. Anchor elements 18 are provided to anchor the mounting plate 12 and support plate(s) 14 to the vertical support. Where two support plates 14 are provided, as shown in FIGS. 1-3, intermediate elements 20 are used to separate and support the two plates. In accordance with a further feature, adjustable spacers 22 may be mounted to the mounting plate 12 to offset the plate from the vertical support, as described herein.

Figure 5:
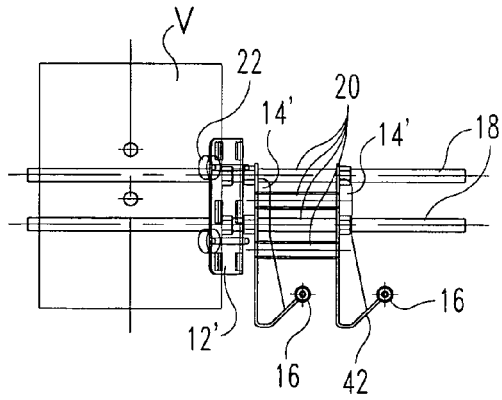
FIG. 5 is a side view of the fall protection anchor system shown in FIG. 4.
Figure 6:
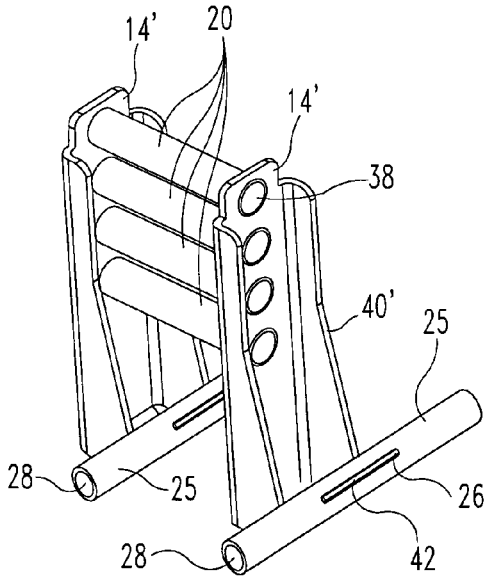
FIG. 6 is a perspective view of the support plate construction incorporated into the anchor system shown in FIGS. 4-5.
Figure 7:
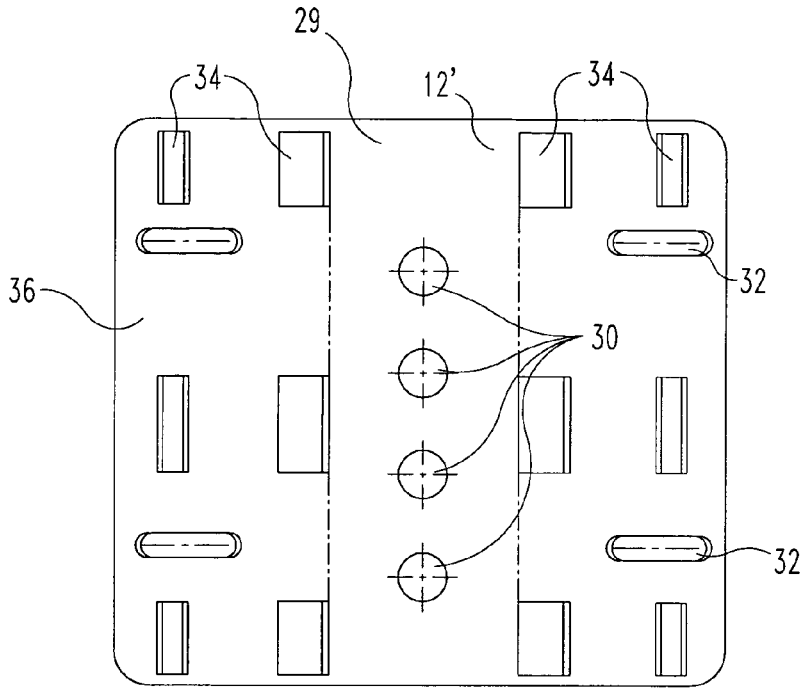
FIG. 7 is a front view of the mounting plate incorporated into the anchor system shown in FIGS. 4-5.
Figure 8:
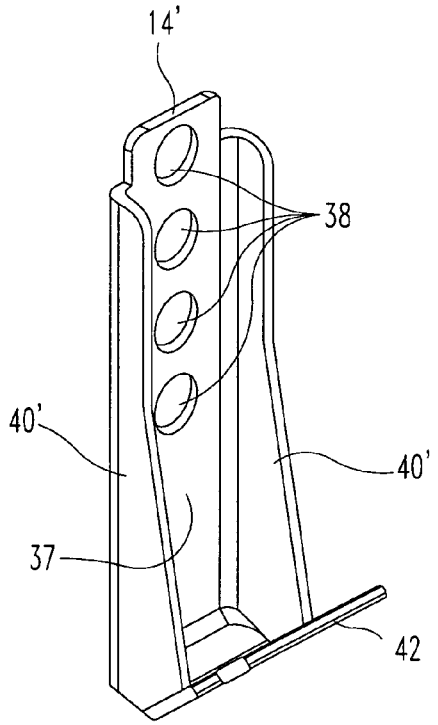
FIG. 8 is a front perspective view of the support plate used in the construction shown in FIG. 6.

A modified anchor system 10' is depicted in FIGS. 4-8. In this modified embodiment, the mounting plate 12' is configured to be mounted to the vertical support V (FIG. 5) by several different types of anchor elements 18. In the embodiment shown in FIG. 1, the anchor elements 18 are restricted to long threaded shafts or bolts that are sized to extend diametrically through the vertical support V, as shown in FIG. 2. In the embodiment shown in FIG. 4, the mounting plate 12' is configured to accept the same threaded shaft or bolt configuration. In addition, the plate 12' is configured to accept clamping bands configured to encircle the vertical support. Thus, the mounting plate 12' includes a vertical array of holes 30 that are sized to accept the threaded anchor shaft 18, as shown in FIG. 7. The plate 12' further includes an arrangement of slots 34, with a pair of slots adjacent each side of the plate. The plate 12' preferably includes three rows of such slots 34. The slots are configured to receive an anchor strap or band threaded through each slot in a particular row. Preferably, a strap or band is threaded through each of the three rows depicted in FIG. 7 to provide the maximum gripping force between the anchor system 10' and the support V.

Figure 4:
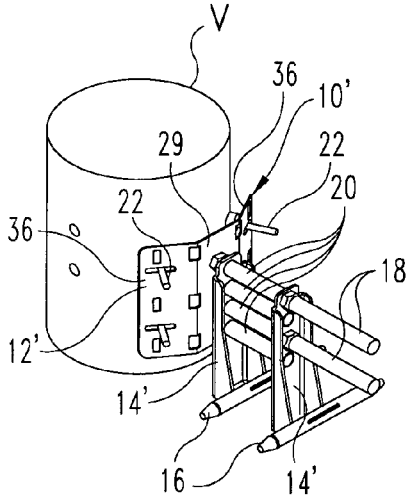
FIG. 4 is a front perspective view of a fall protection system similar to that shown in FIGS. 1-3.

As shown in FIGS. 1 and 4, the mounting plates 12, 12' include a central plate portion 29 in which the anchor holes 30 are defined. The plates further include wings 36 at each side of the central portion 29. The wings are arranged at an angle relative to the central portion so that the plates 12, 12' exhibit a generally arcuate form. Thus, the plates are configured to be mounted to a generally cylindrical vertical support, such as a tree or a post. Since the general arcuate shape of the mounting plates 12, 12' are unlikely to correspond exactly to the shape of the vertical support, the anchor systems 10, 10' are provided with spacers 22. The spacers are preferably adjustably attached to the mounting plates so that the side-to-side position of the spacers 22 may be adjusted. Moreover, the spacers 22 are preferably configured to permit in and out adjustment to conform to irregularities in the surface of the vertical support.

Thus, in one aspect, the plate 12' includes an array of generally horizontal slots 32 defined in the angled wings 36. The spacers 22 are thus preferably include an adjustable mounting bolt arrangement, akin to a height adjustment mechanism for a table or chair. Thus, the spacer 22 may include a head 23 with a threaded stem **24*a* projecting therefrom, as best shown in FIG. 3. Nuts 24*b* are threaded onto the stem on opposite sides of the plate 12 with the stem 24*a* extending through a slot 32 in the mounting plate. Thus, when the mounting plate is initially mounted to the vertical support using the anchor elements 18, the position of the head 23 of each spacer 22 may be adjusted in and our and from side to side with the nuts 24*b* initially loose. When the spacer is properly positioned it will place the anchor elements 18 in tension to strengthen the mounting of the anchor system 10, 10' to the vertical support. The nuts 24*b*** may then be fully tightened to firmly clamp the spacers to the support plate.

Figure 11:
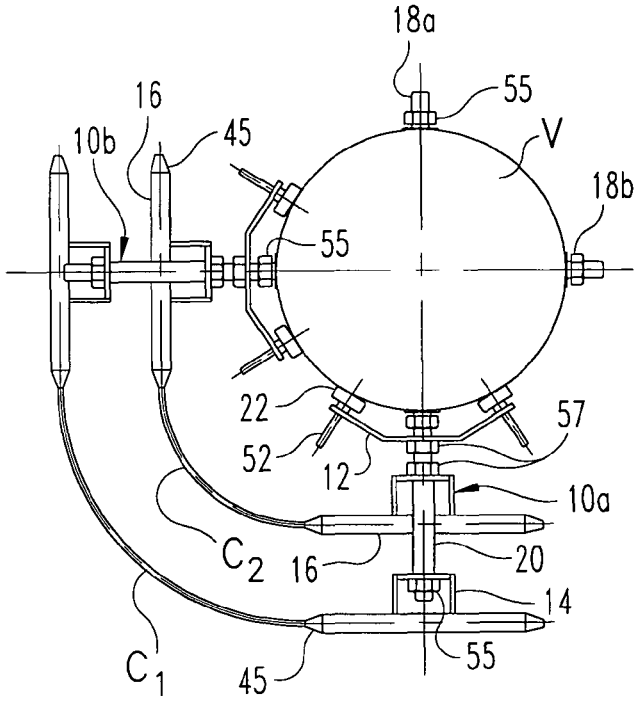
FIG. 11 is a top view of a pair of fall protection anchor systems according to the present invention, shown mounted to a common vertical support.
Figure 12:
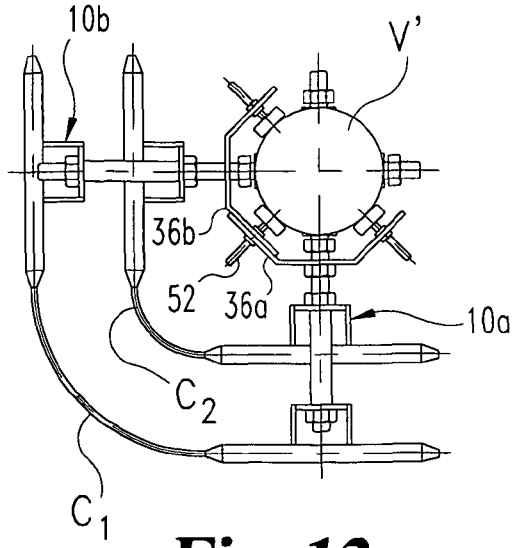
FIG. 12 is a top view of a pair of fall protection anchor systems according to the present invention, shown mounted in overlapping relation on a common vertical support.

In one aspect of the inventive anchor system, the mounting plates 12, 12' include a sufficient number of mounting holes 30 to accommodate multiple anchor positions for the plate. As best seen in FIG. 6, the plate 12' includes four holes 30 in the vertical row. As shown in FIGS. 2 and 4, the anchor systems may be solidly anchored to the vertical support V using two anchor elements 18. Thus, only two of the four holes 30 are needed to receive a corresponding anchor element. When only one anchor system 10, 10' is to be supported on a given vertical support, the anchor elements 18 may extend through any of the four holes 30. However, in other arrangements, two anchor systems must be mounted to a single vertical support, such as when the belay line is traveling around or inside a corner. Thus, as shown in FIGS. 11-12, two anchor systems must be affixed to the same vertical support V. In this instance, the four holes 30 in the support plate 12' allow staggered positioning of the anchor elements 18. As shown in FIG. 5, the anchor elements 18 extend through the first and third holes from the top of the mounting plate 12' for the anchor system **10*a*. In the mounting plate for the other anchor system 10*b*, the anchor elements extend through the second and fourth holes 30. In this way, the anchor elements 18 do not interfere with each other. At the same time, the vertical position of the shuttle guides 16 is consistent between the two anchor systems 10*a* and 10*b***.

Figure 9:
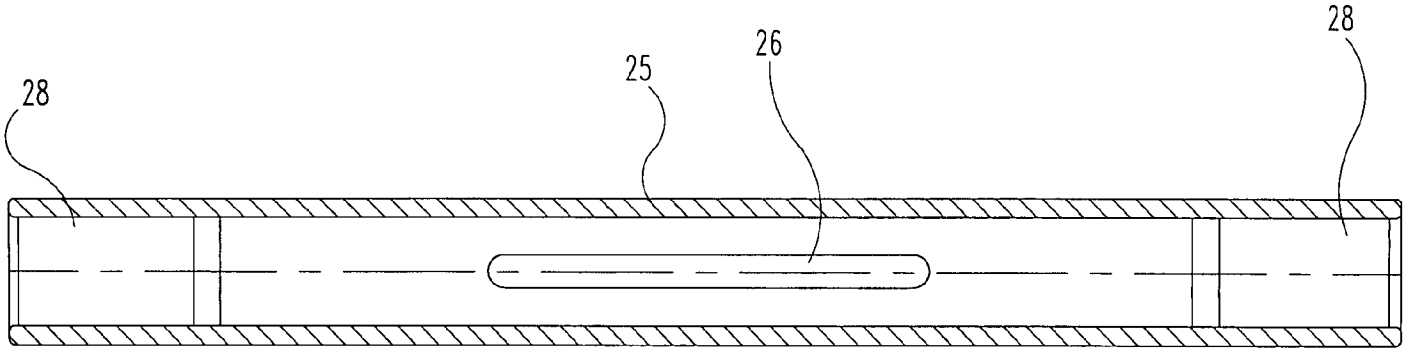
FIG. 9 is a top view of a shuttle guide incorporated into the anchor system shown in FIGS. 4-5.

It can be appreciated that the anchor systems of the present invention are modular in nature, thereby allowing the same components to be installed in different constructions. For instance, the anchor systems 10 include separate support plates 14, 14' that may be mounted to a corresponding mounting plate. The support plates may be constructed similar to the plate 14' illustrated in FIG. 8. This plate 14' includes a central plate 37 which defines a row of holes 38 that correspond to the holes 30 on the mounting plate 12, 12'. Stiffening flanges 40' are provided at the sides of the central plate. (It can be noted that the plate 14 in FIG. 2 is similar to plate 14' with the modification that the stiffening flanges 40 are configured differently from the flanges 40'). The stiffening flanges 40' are attached to a guide tube plate 42 that extends outward and upward relative to the central plate 37. The guide tube plate 42 mates with the guide tube 25 (FIG. 9) which forms part of the shuttle guide 16 (FIGS. 1 and 4). In particular, the guide tube 25 is provided with a longitudinal slot 26 through the tubular body, as shown in FIG. 9. The guide tube 25 is preferably welded to the plate 42 so that each support plate 14, 14' provides a complete structure, as shown in FIG. 6.

As indicated above, in some applications only a single support plate 14, 14' and guide tube 25 is required. However, in other installations, two belay lines (ropes or cables) are provided along a common course. In these installations, two shuttle guides 16 and guide tubes 25 are necessary. The modular design of the support plate 14, 14' can be readily combined to accommodate a dual track course, as shown in FIGS. 4-6. Two support plates 14' may be connected using several intermediate elements or tubes 20, as best seen in FIG. 6. Preferably, four tubes 20 are provided to correspond to the four holes 38 in the central plate 37 of the support plate. In one embodiment, the tubes 20 are welded to each support plate 14' so that a solid and rigid construct is formed. Alternatively, a nut and bolt arrangement may be used to fix each tube to the support plate. In this alternative approach, the anchor elements 18 may be used to fasten the intermediate tubes to the support plates in the manner described above.

Preferably, the two support plates and four intermediate tubes are welded together to form a separate modular component, as shown in FIG. 6, that can be used where appropriate on the obstacle or adventure course. Any one of the four intermediate tubes can accept an anchor element for attaching the modular support plate construct to the mounting plate 12, 12'. Again, as explained above, two anchor elements may extend through offset pairs of intermediate tubes, especially when two anchor systems are being mounted to a single vertical support.

As shown in FIG. 9, the guide tube 25 for each shuttle guide 16 are preferably tubular with internally threaded ends 28. These threaded ends provide another modular feature for the anchor system. In particular, the threaded ends 28 are configured to accept a profile tip 45 that is used to fasten a belay line segment to the corresponding end of the guide tube. In other words, rather than carrying a continuous belay line throughout the entire length of the run, the present invention contemplates breaking the run up into discrete belay line segments, with the segments connected to each other through the shuttle guides 16.

Figure 10:
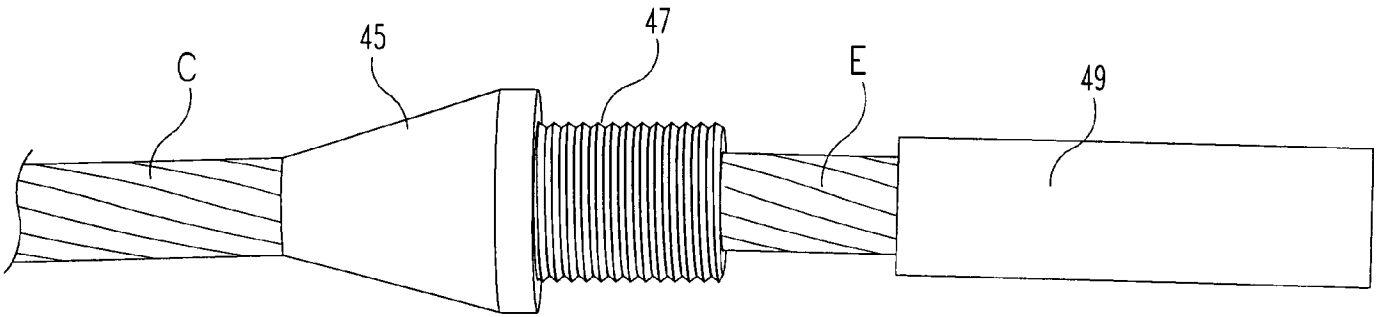
FIG. 10 is a side view of a cable segment attachment feature incorporated into the anchor system shown in FIG. 4-5.

More specifically, the cable segments C are threaded through the profile tip 45. A ferrule 49 is permanently fixed to the free end E of the cable C, such as by crimping or welding. The cable segments C may thus be provided in predetermined lengths with a properly oriented profile tip 45 trapped at each end E of the cable by a corresponding ferrule 49. The profile tip 45 includes a threaded stem 47 that is adapted for threaded engagement within the threaded end 28 of the guide tube 25. Thus, in order to construct a cable run for an outdoor course, it is only necessary to place the ferrule 49 and cable end E within one end of the guide tube and then thread the profile tip 45 into the threaded end 28 of the guide tube 25. It is contemplated that the threaded engagement between the guide tube end 28 and profile tip stem 47 incorporate dense threads to ensure a pull-out force that exceeds the load limit for the cable system. The profile tip 45 is tapered as shown in FIG. 10 so that the shuttle may transition smoothly from the belay line onto the shuttle guide 16 as the participant traverses the anchor system 10, 10'.

Figure 13:
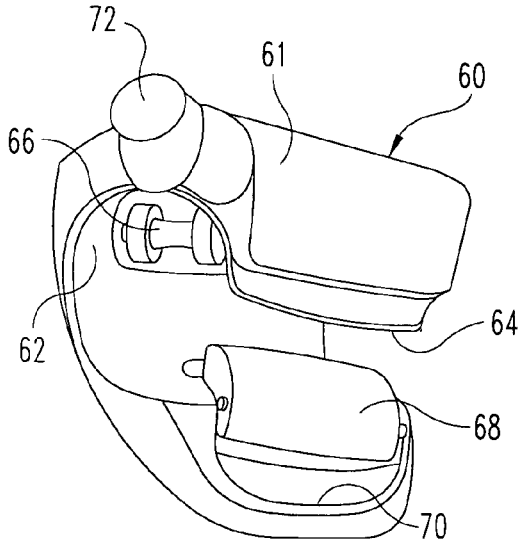
FIG. 13 is a perspective view of a shuttle for use with the fall protection anchor system shown in the prior figures.

The anchor system 10, 10' of the present invention is configured to accommodate a wide range of shuttle designs. One such shuttle 60 is depicted in FIG. 13. The shuttle 60 is in the form a generally C-shaped metal body 61 that defines a cable channel 62 through which the belay line extends when the shuttle is slidably mounted thereon. An entry slot 64 communicates with the channel and provides a means for placing the shuttle onto a belay line. Rollers 66 may be mounted within the cable channel to facilitate the travel of the shuttle along the belay line.

The entry slot 64 is substantially closed by a gate 68 to prevent unanticipated release of the shuttle from the belay line. Preferably the gate 68 is spring-biased relative to the shuttle body 61 to a position substantially closing the entry slot 64. The gate leaves enough of the entry slot open so that the shuttle 60 can traverse the guide tube plate 42 supporting the guide tube 25 of each shuttle guide 16. A portion of the gate 68 extends into a karabiner slot 70 formed in the body 61 so that the gate cannot be moved from its closing position when a karabiner clip is positioned within the slot 70. When the karabiner slot is empty, the gate 68 may be moved against the spring bias to allow placement of the shuttle 60 over a cable/rope.

The shuttle is preferably formed of a high strength material, such as steel, so that it does not deform or fracture under the weight of the user, even when the shuttle and belay line is the only thing supporting the user following an accidental fall. The cable channel 62 is sized to permit easy passage over the shuttle guides 16 of the anchor system 10, 10'. A bumper 72 may be mounted on the sides of the shuttle body 61 to prevent contact damage to the shuttle along the belay line course.

Turning to FIGS. 11 and 12, certain benefit of the anchor system of the present invention is illustrated. As shown each of these figures, two anchor systems 10*a* and 10*b* are mounted to a common vertical support V. Each anchor system includes an outer cable segment C1 and an inner cable segment C2 extending around a corner. As is apparent from the figures, the cable segments do not interfere with each other and are spaced apart a sufficient distance so that shuttles 60 traveling on each segment do not interfere with each other. It should be understood that each shuttle guide 16 is also connected to another cable segment (not shown) that forms a further part of the rope/cable course. It should also be understood that the anchor system may be used to negotiate an inside corner as easily as the outside corner shown in the figures.

Another benefit of the inventive system is that a common arrangement may be used for virtually any size vertical support. In particular, it can be seen by comparing FIGS. 11 and 12 that the vertical support V in FIG. 11 has a larger diameter than the support V' in FIG. 12. However, the same anchor systems 10*a* and 10*b* may be mounted to each support. For the larger vertical support V, the anchor systems 10*a* and 10*b* are circumferentially offset. For the smaller vertical support V', the two anchor systems overlap. In particular, the adjacent side wings 36*a* and 36*b* overlap and are connected to each other by a pair of common spacer adjustment screws 52. Of course, in the case of the smaller vertical support, the cable segments C1 and C2 will be shorter.

The fall protection anchor system 10, 10' of the present invention provides standardized components for a modular construction that can be adapted to virtually any mounting surface. While the mounting plate 12 is preferably configured for mounting on a generally cylindrical support, such as a tree or post, it can also be used for mounting to a vertical wall using the same anchor elements 18. The mounting plate 12' also provides alternative means for mounting the plate to a support structure, in the form of the slots 34 for engagement of a mounting strap, band or cable. The spacers 22 can be adjusted to conform to any support surface, while maintaining tension in the anchor element for a solid fixation of the anchor system to the vertical support.

The support plates 14, 14' are separate from the mounting plates 12, 12', further enhancing the modularity as well as ease of assembly of the system. In particular, the separate support plates permits the placement of a single plate and associated shuttle guide 16 at a particular location, or a pair of plates and shuttle guides at a different location. Although the shuttle guides 16 are integral with the support plates 14, 14', the profile tips 45 and cable segments C are separate and may be added to the system at any time. This feature not only facilitates construction of the rope/cable course, it also allows for easy replacement of a worn cable segment instead of replacing an entire cable run.

The vertical array of holes 30 in the mounting plate 12 and holes 38 in the support plate allows two anchor systems to be fastened to a common vertical support without interference between the anchor elements. This feature ensures that the shuttle guides for each anchor system will be positioned at the same height to avoid disruption of the cable run. Where only a single anchor system is utilized, the multiple holes allow selection of an optimum location for the anchor elements.

Another benefit of this modularity is that the mounting plate 12 may be eliminated for certain installations. While the mounting plate is particularly useful for attaching the anchor system to an uneven surface, such as a tree, it may not be necessary for belay line systems anchored to pre-fabricated posts. In this instance, the support plates 14 themselves may be directly fastened to and in flush contact with the post using an appropriately sized anchor element or bolt 18. With the support plate flush against the vertical post, the attachment nut 57 (FIG. 3) is not required.

A further benefit of the anchor system 10, 10' is that the dual safety lines are horizontally offset, rather than vertically as in prior systems. Thus, as shown in FIG. 11, the cable segments C1 and C2 are horizontally offset so that the shuttle and fall arresting systems traveling along each cable run will not interfere with each other. This arrangement greatly facilitates dual participant rope courses, for instance, since either participant can easily travel past the other along the same run of the course. Moreover, the horizontal offset between the two cable runs helps avoid conflicts when it is necessary for emergency personnel to hurry along a run to aid a stranded participant.

In a further embodiment of the invention, the ability to transfer a belay line shuttle between unconnected belay lines is contemplated. Thus, in one embodiment depicted in FIGS. 14-15, a transfer station 100 is engaged to a vertical support V. The transfer station is preferably accompanied by a platform P on which the participant stands while effecting the transfer of the shuttle, such as shuttle 60 between the belay line runs.

Figure 14:
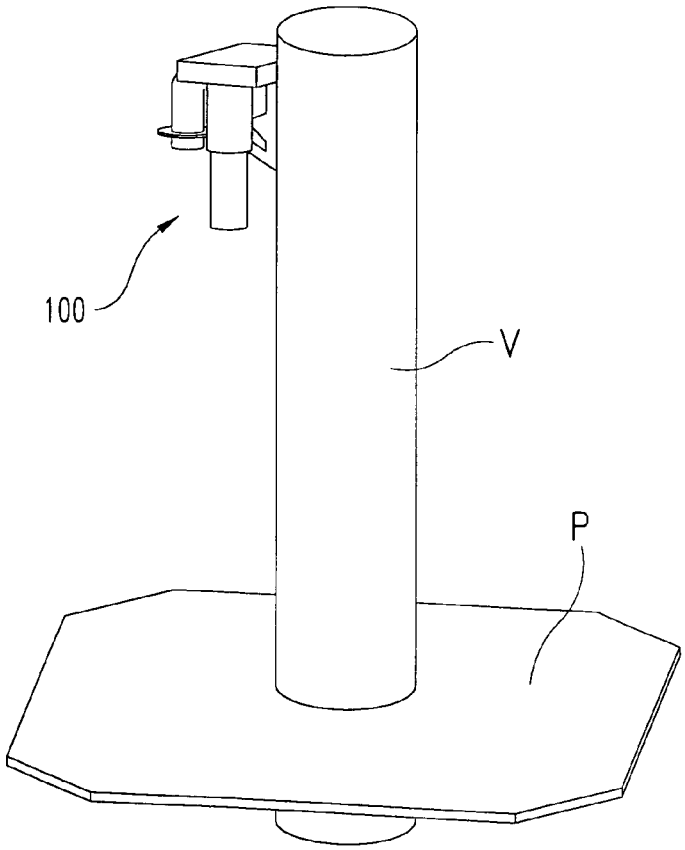
FIG. 14 is a perspective view of a shuttle transfer station according to a further embodiment of the invention.
Figure 18:
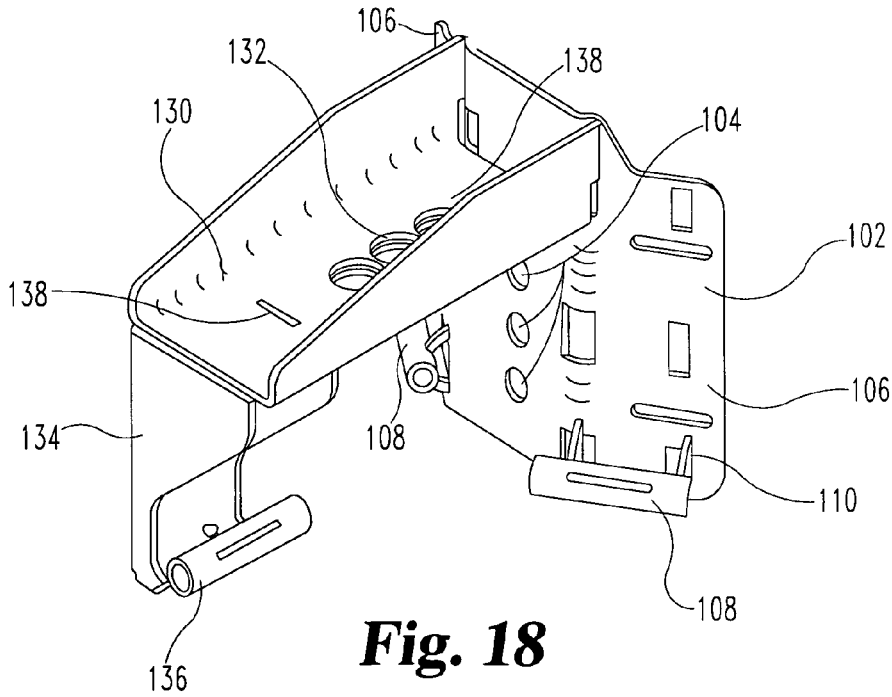
FIG. 18 is a perspective view of a mounting plate component of the shuttle transfer station shown in FIG. 15.

As shown in more detail in FIG. 14, the transfer station 100 includes a mounting plate 102 that is similar to the mounting plate 12 of the embodiment shown in FIG. 7. Thus, the mounting plate 102 includes a plurality of mounting openings 104 that accept anchor elements, such as the bolts 18 shown in FIGS. 1-2, and openings 105 that are configured for strap mounting of the plate to the vertical support. Unlike the mounting plate 12, the mounting plate 102 includes shuttle guides 108 carried by a support flange 110 formed on each wing 106, as best seen in FIG. 18. Thus, each wing 106 includes a shuttle guide 108 disposed at an angle relative to each other. In particular, each shuttle guide is essentially parallel to a line tangent to the vertical support beneath each wing.

The outboard end of each shuttle guide 108 includes a profile tip 45 that fixes a cable to the shuttle guide in the manner described above in connection with FIG. 10. Thus, each shuttle guide 108 interfaces with a different belay line run unconnected with each other.

Figure 16:
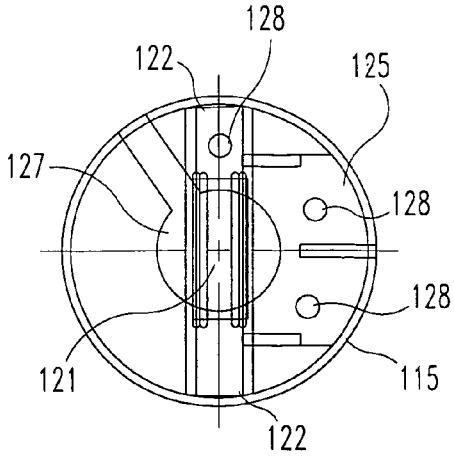
FIG. 16 is a top elevational view of a rotating barrel component of the shuttle transfer station shown in FIG. 15.
Figure 17:
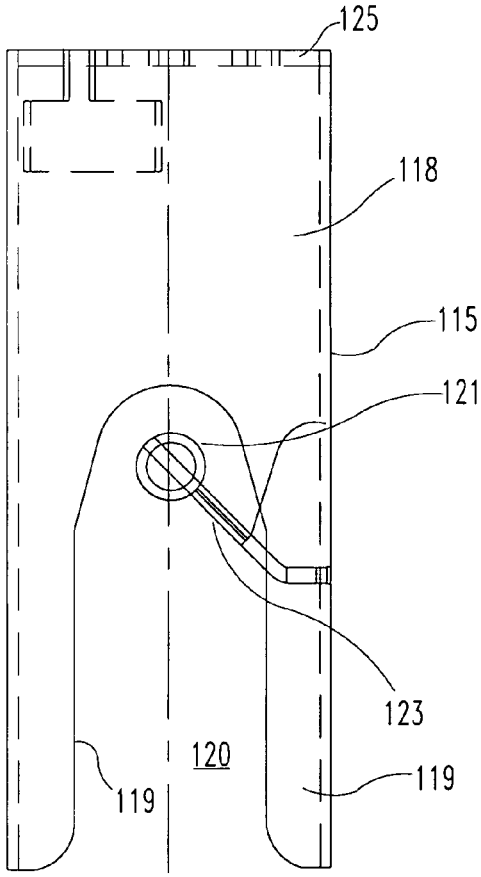
FIG. 17 is a side view of the rotating barrel component shown in FIG. 16.

In order to transfer the safety shuttle between these cable runs, the transfer station 100 further comprises a rotating barrel 115, as shown in FIGS. 16-17. This rotating barrel includes a pair of handles 117 at its lower end that may be grasped by the user to rotate the barrel. The barrel 115 includes an upper cylindrical body 118 that extends into lower segments 119. These segments define a thru-slot 120 that permits passage of a shuttle through the barrel 115. In one aspect of the invention, the rotating barrel 115 is provided with its own transfer shuttle guide 121 that is supported on the inside of the barrel by a flange 123 (FIG. 17). The transfer shuttle guide 121 is oriented so that its ends face the openings of the thru-slot 120. It can be readily appreciated that when the barrel 115 is rotated to one position the slot 120 will face a selected one of the shuttle guides 108 associated with one of the belay line runs. Consequently, the transfer shuttle guide 120 will also be aligned with the belay line shuttle guide 108 so that a shuttle traveling on that line may be easily transitioned onto the shuttle guide 120 carried by the rotating barrel. Once the shuttle (e.g., shuttle 60) is positioned on the transfer shuttle guide, the barrel may be rotated until the opening 120 and transfer shuttle guide 120 are facing the other outboard shuttle guide. The shuttle may then be transitioned onto the other cable run.

In order for the barrel 115 to rotate, it is provided with a top plate 125 that defines a central opening 127, as shown in FIG. 16. The top plate may also be provided with indexing elements 128 that correspond to pre-determined rotational positions of the barrel that align with shuttle guides at the end of belay line runs. As described below, the barrel 115 is supported beneath an upper mounting plate 130 (FIG. 18) that is itself fastened to the mounting plate 102 in a suitable manner. The upper mounting plate thus extends generally perpendicularly outward from the mounting plate and the vertical support. The upper mounting plate 130 defines a notched opening 132 that is aligned with the opening 127 in the rotating barrel 115.

Figure 15:
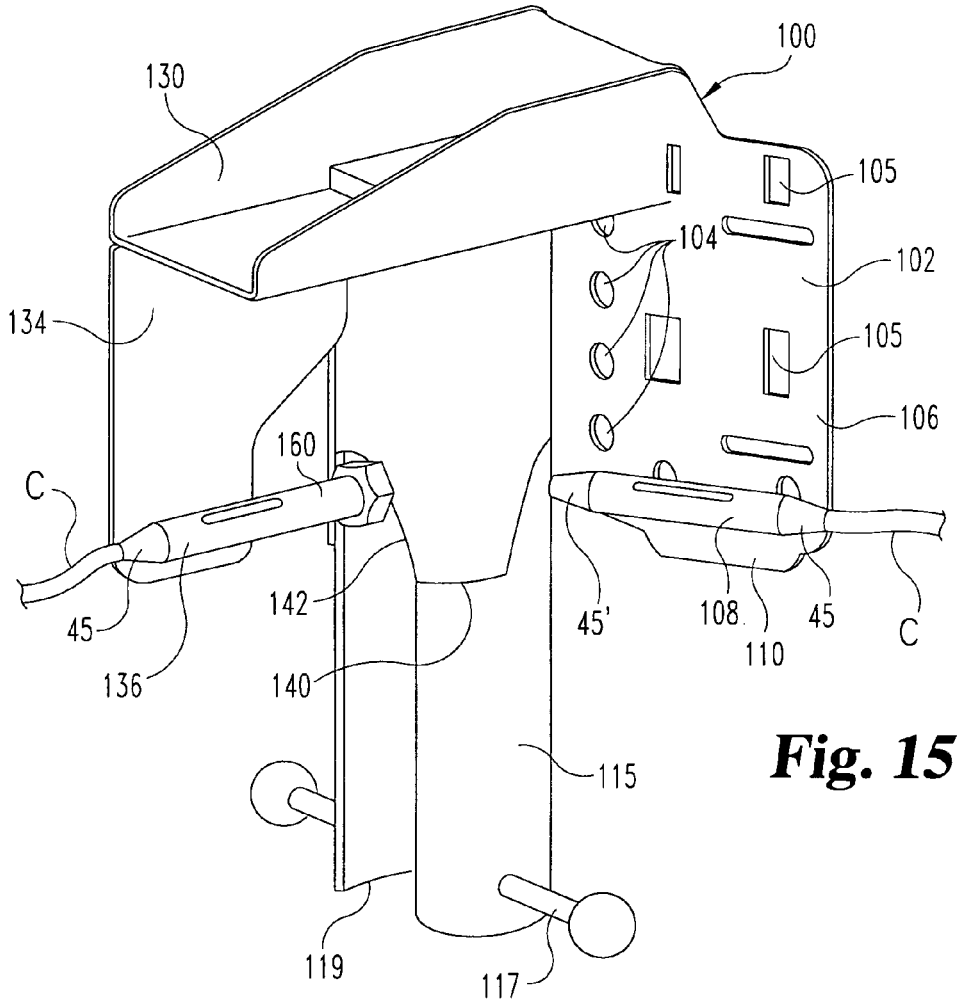
FIG. 15 is an enlarged perspective view of the shuttle transfer station shown in FIG. 14.
Figure 19:
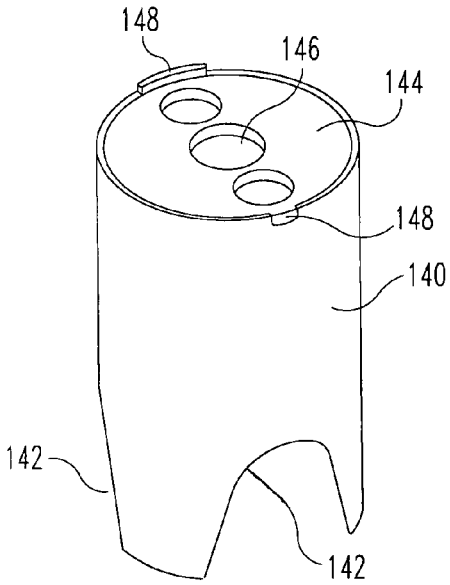
FIG. 19 is a perspective view of a guide barrel component of the shuttle transfer station shown in FIG. 15.
Figure 20:
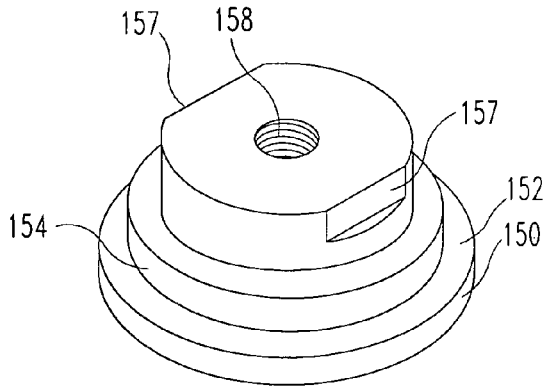
FIG. 20 is a perspective view of a pivot pin component of the shuttle transfer station shown in FIG. 15.

The upper mounting plate 130 further defines engagement features 138 that are configured to accept corresponding engagement features 148 on a guide barrel 140 shown in FIG. 19. The guide barrel 140 is sized to closely encircle the upper cylindrical body 118 of the rotating barrel, as shown in FIG. 15. Thus, the guide barrel 140 is fastened to the upper mounting plate 130 by engagement of the features 138 and 148. These features may be tabs and slots that are suitable connected, such as by welding.

The guide barrel 140 is a generally cylindrical tube, although notches 142 are formed at the base of the barrel, as shown in FIG. 19. These notches correspond to the shuttle guide for each belay line run that converges on the particular vertical support on which the transfer station is mounted. Thus, in the illustrated embodiment of FIG. 15, three belay lines converge at the station 100, so the guide barrel 140 defines three uniformly spaced notches 142. The guide barrel is fastened to the upper mounting plate 130 so that the notches are fixed in alignment with the belay line shuttle guides.

The guide barrel 140 may include a top plate 144 that defines a central opening 146 that is aligned with the two openings 127 and 132 when the transfer station is assembled. In particular, a pivot pin 150 is provided that extends through each of these openings and fastens the three components together while permitting rotation of the rotating barrel 115. The pivot pin 150 includes a lower disc 152 that has a diameter larger than the diameter of the pivot opening 127 in the rotating barrel. The disc 152 transitions into an intermediate disc 154 that is sized to fit snugly within the central opening 146 of the guide barrel 140. The upper end of the pivot pin 150 is a mounting hub 156 having opposing flats 157. The mounting hub is configured to fit within the opening 132 in the upper mounting flange. The flats 157 interface with the notched opening 132 so that the pivot pin 150 does not rotate. The mounting hub 156 defines a threaded bore 158 that accepts a screw or carriage bolt used to firmly fasten the pivot pin 150 to the upper mounting plate 130. Thus, the pivot pin is used to fasten the rotating barrel 130 and the guide barrel 140 beneath the mounting plate, as shown in FIG. 15. At the same time, the lower disc 152 provides a surface for rotating support of the top plate 125 of the rotating barrel 115, which thus allows the barrel to be rotated by manual pressure on the handles 117.

As alluded to above, the transfer station 100 is configured to accept three belay line runs converging on the same vertical support. The third cable run is carried by a shuttle guide 136 supported at the end of flange 134, as shown in FIG. 18. This flange 134 is affixed to the upper mounting plate 130 in a suitable and secure manner, such as by welding. In the illustrated embodiment, this third shuttle guide 136 is oriented perpendicular to the vertical support and generally mid-way between the two outboard shuttle guides 108. Thus, the transfer station 100 provides the participant with the ability to select between two belay line runs when the participant is connected to any given cable run.

In a further aspect of the transfer station 100, the inboard ends of the shuttle guides 108 and 136 may terminate in a profile tip 45', as shown in FIG. 15. Since no belay line is supported at the inboard end of these shuttle guides, the profile tip 45' need not be configured to engage the end of a cable (as with the tip 45 shown in FIG. 10). Instead, the profile tip 45' may be solid or may be the same as the profile tip 45 without the cable passing through the tip. Alternatively, the inboard end of the shuttle guides may be themselves configured with a tapered tip, although this alternative is at the cost of full modularity for the system.

In some embodiments, the inboard end of the shuttle guides 108 and 136 do not require any tapered profile. It is contemplated in these embodiments that the inboard end of the shuttle guides will be oriented sufficiently close to the rotating barrel 115 and more specifically to the ends of the transfer shuttle guide 121. As shown in FIG. 16, the ends 122 of the transfer shuttle guide 121 are aligned with the wall of the barrel. Thus, in this embodiment the ends of the interior and outboard shuttle guides will be separated by slightly more than the wall thickness of the rotating barrel. This gap may be easily traversed by the shuttle as the participant moves it from shuttle guide to shuttle guide.

Figure 21:
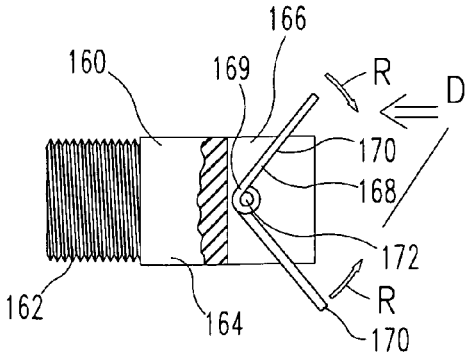
FIG. 21 is a side view of a uni-directional one-way tip for a shuttle guide in accordance with a further embodiment of the invention.

In yet another embodiment, the inboard end of one or more of the shuttle guides 108 and 136 may be provided with a unidirectional tip 160, as depicted in FIG. 15. As shown in the detail view of FIG. 21, the unidirectional tip 160 includes a threaded stem 162 that is configured to engage the shuttle guide in the manner described above in connection with the profile tip 45. The body 164 of the tip defines a central slot 166 that houses a torsion spring 168. The hub 169 of the torsion spring may be held to the body 164 by a press-fit pin 172. The arms 170 of the spring project outward from the slot and beyond the circumference of the body 164. Thus, the arms 170 prevent passage of a shuttle in the direction D over the tip 160 because the shuttle will contact the legs and push them against the body. On the other hand, when the shuttle passes in the opposite direction, the legs 170 rotate toward each other in the direction R as the shuttle passes over the tip 160. It can be appreciated that the unidirectional tip 160 may be used to control the direction of travel along a particular belay line run.

In the embodiment shown in FIG. 15, a participant would be unable to move from one of the outboard shuttle guides 108 onto the third shuttle guide 136 because passage would be blocked by the spring arms on the unidirectional tip 160. However, the participant would be able to travel from the shuttle guide 136 to either of the other two guides 108.

Figure 22:
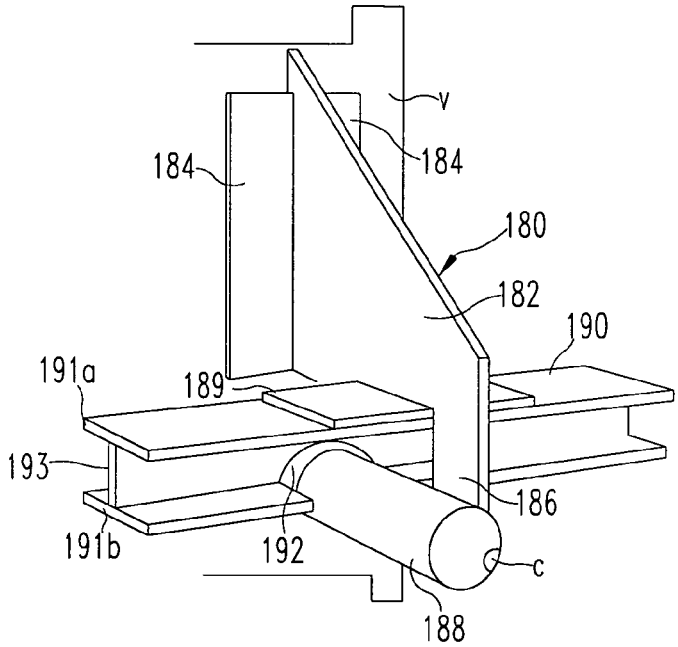
FIG. 22 is a perspective view of a shuttle transfer station according to another embodiment of the invention.
Figure 23:
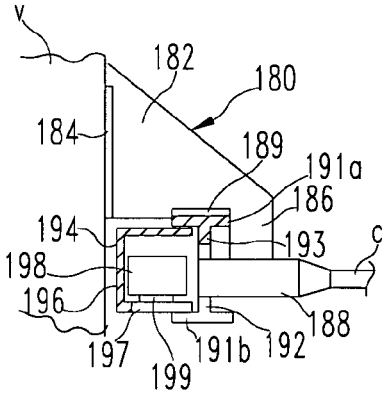
FIG. 23 is a side partial cross-sectional view of the shuttle transfer station shown in FIG. 22.
Figure 24:
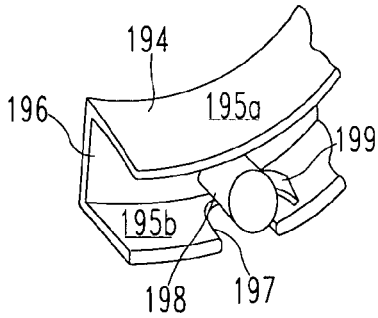
FIG. 24 is a partial cur-away view of a transfer ring component of the shuttle transfer station shown in FIG. 22.

The present invention further contemplates an alternative transfer station 180 as shown in FIGS. 22-24. In this embodiment, the transfer station incorporates a continuous ring that encircles the vertical support V, thereby accommodating multiple entry and exit points. The transfer station 180 includes a series of mounting plates 182 with mounting flanges 184 for suitably fixing the mounting plates at spaced locations around the circumference of the vertical support (although only one such mounting plate is shown in FIG. 22). Each mounting plate 182 incorporates a support flange 186 that is configured to support an associated cable end shuttle guide 188. The support flange 186 may be configured similar to the support plates 14 shown in FIG. 6 in that the flange is angled upward to carry the shuttle guide 188, thereby providing a generally rigid support for the terminal end of a belay line run.

The plurality of mounting plates 182 are fastened to a continuous guide beam 190 that encircles the vertical support V. The guide beam may be fastened to the mounting plates by way of bolt plates 189 affixed to the mounting plate and configured to receive bolts (not shown) for fastening to the upper web 191*a* of the beam. Alternatively, or in addition, certain portions of the mounting plates may be welded to the beam. In the preferred embodiment, the guide beam 190 is an I-beam to provide strength and rigidity to the transfer station construction. Thus, the beam includes upper and lower webs 191*a*, 191*b* and a vertical web 193 connecting the upper and lower webs. A cut-out 192 is defined in the vertical web 193 and the lower web 191*b* to provide passage for a shuttle. Preferably, the shuttle guide 188 is sized to extend through the cut-out 192, as best seen in FIG. 23.

The guide beam 190 acts as a guide rail for a transfer ring 194 that is slidably disposed between the vertical web 193 and the surface of the vertical support V, as depicted in FIG. 23. The transfer ring is preferably in the form of a U-shaped channel beam with upper and lower webs 195*a*, 195*b* separated by a vertical web 196. The transfer ring 194 is sized for running clearance between the vertical support V and the guide beam 190. The height of the transfer ring (i.e., the width of the channel between the upper and lower webs 195*a*, 195*b*) is also sized to provide a close running fit between the upper and lower webs 191*a*, 191*b* of the guide beam. This close running clearance will keep the transfer ring from dislodging or becoming cocked within the I-beam construction of the guide beam, while still permitting smooth rotation of the transfer ring 194 relative to the stationary guide beam 190. For added security, a circumferential angle beam (not shown) may be fastened to the vertical support to provide support for the inboard circumference of the transfer ring.

As shown in FIGS. 23-24, the transfer ring 194 carries a plurality of inner shuttle pegs 198 fastened to the lower web 195*b* by a support 199. Each inner shuttle peg 198 is situated over a cut-out 197 defined in the lower web 195*b* to provide an access path for a karabiner and support ropes connected to a safety shuttle. It can be appreciated that the transfer ring 194 may be positioned relative to the fixed guide beam 190 so that the inner shuttle peg 198 is aligned with the shuttle guide 188 at the end of the cable run C, as illustrated in FIG. 23. Likewise, the cut-out 197 in the transfer ring is aligned with the cut-out 192 in the guide beam to allow free passage of a shuttle to and from the two guides 188, 198.

The U-shaped channel of the transfer ring 194 is sized to safely contain a shuttle supported on the peg 198. Thus, the space between the shuttle peg 198 and the upper web 195*a* is sufficient for clearance of the upper portion of a shuttle, but not so great that the shuttle may rattle within the transfer ring.

The transfer ring 194 preferably includes several shuttle pegs 198 spaced around the circumference of the ring. Although only one shuttle peg is used by a participant to transfer his/her shuttle between belay line runs, the provision of several such pegs reduces the "fiddle factor"—i.e., the user need only rotate the transfer ring 194 a short distance to align a shuttle peg 198 with the shuttle guide 188 on which his/her shuttle is currently resting. Once the shuttle has been transferred from the cable end shuttle guide 188 to the shuttle peg 198, the participant simply rotates the transfer ring until the shuttle peg is aligned with a different shuttle guide at another angular position on the vertical support V. As with the transfer station 100 shown in FIG. 14, a platform P is provided below the transfer station 180 so that the user can walk around the platform while rotating the transfer ring 194.

It can therefore be appreciated that the transfer station 180 of this embodiment provides a ready interface to a multiplicity of belay line runs converging at a single vertical support V. Preferably, the belay line runs are separated by a circumferential distance of about ½ meter to avoid the potential for entanglement as the participant tries to negotiate around the vertical support between cable runs. Thus, the number of belay line runs that can preferably converge at a single vertical support is a function of the diameter of that support—i.e., the larger the diameter, the greater the circumference and the larger number of mounting plates 180 and shuttle guides 188 that can be mounted to the support. For example, for a one meter diameter support pole, six shuttle guides 188 may be comfortably spaced around the circumference, which means that six different belay line runs may converge at the single support pole. Preferably, pairs of mounting plates are fastened to the vertical support at diametrically opposite positions so that common anchors may pass through the support and between the pairs of mounting plates.

In the illustrated embodiment, the shuttle guide 188 and shuttle peg 198 do not incorporate a profile tip at their inboard ends since the gap between the shuttle supports is easily bridged by a shuttle passing between the two. However, it is contemplated that the inboard end some of the cable run shuttle guides 188 may incorporate the unidirectional tip 160. The unidirectional tip 160 would preferably be oriented to allow a user to transfer his/her shuttle from the shuttle guide 188 to the transfer ring, but not permit passage of the shuttle from the transfer ring onto the cable run shuttle guide. Thus, the unidirectional tip 160 may be used to control which of several belay line runs a participant may select when leaving one cable run.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. An anchor system for a fall protection system having belay lines extending between vertical supports and adapted to slidably receive a shuttle coupled to a person traversing the belay lines, the anchor system comprising:

a mounting plate defining a first plurality of openings therethrough;

a support plate defining a second plurality of openings corresponding to said first plurality of openings, said support plate carrying a shuttle guide thereon, said shuttle guide configured for slidable passage of a shuttle thereover and further configured to be coupled to the belay lines; and a plurality of anchor elements having a first portion configured to extend through a corresponding one of said first and second plurality of openings in said mounting plate and a second portion configured for engaging a vertical support.

2. The anchor system of claim 1, wherein said anchor elements include:

a threaded rod sized to extend through the mounting and support plates and the vertical support; and a pair of threaded nuts for threadedly engaging said threaded rod to clamp said support plate therebetween.

3. The anchor system of claim 1, wherein:

said first and second plurality of openings includes at least four openings; and said plurality of anchor elements includes two rods for extending through any two of said first and second plurality of openings.

4. The anchor system of claim 1, further comprising a second like configured support plate defining a third plurality of openings corresponding to said first and second plurality of openings, said first portion of said anchor elements configured to extend through said third plurality of openings as well as said first and second plurality of openings.

5. The anchor system of claim 4, further comprising a plurality of tubes corresponding to said third plurality of openings, said plurality of tubes engaged to each of said support plates, each aligned with a corresponding one of said second and third plurality of holes, each of said plurality of tubes configured to receive a corresponding one of said anchor elements therethrough.

6. The anchor system of claim 1, wherein:

said anchor elements include a strap or band configured to encircle a vertical support; and said mounting plate defines an arrangement of slots configured to receive said anchor elements therethrough to mount said mounting plate to the vertical support.

7. The anchor system of claim 1, further comprising a plurality of adjustable spacers supported by said mounting plate and arranged to contact the vertical support when the mounting plate is mounted thereto.

8. The anchor system of claim 7, wherein said mounting plate is generally rectangular in configuration and said plurality of spacers includes a spacer adjacent each corner of said mounting plate.

9. The anchor system of claim 1, wherein said shuttle guide includes:

a tubular body, the opposite ends defining internal threads; and a pair of hollow profile tips, each having a tapered surface for sliding passage of a shuttle thereover and a threaded stem for engagement with said internal threads at a corresponding one of said opposite ends.

10. The anchor system of claim 9, further comprising:

a belay line segment forming part of the belay lines for the fall protection system, said belay line segment extending through one of said pair of hollow profile tips with an end thereof disposed within said tubular body of said shuttle guide; and a ferrule engaged to said end of said belay line segment, said ferrule sized to be retained within said tubular body when said one profile tip is in threaded engagement with said internal threads at one of said opposite ends of said tubular body.

11. An anchor system for a fall protection system having belay lines extending between vertical supports and adapted to slidably receive a shuttle coupled to a person traversing the belay lines, the anchor system comprising:

first and second like configured mounting plates, each defining at least four first openings therethrough;

first and second like configured support plates, each defining at least four second openings corresponding to said first openings, said support plates each carrying a shuttle guide thereon, said shuttle guide configured for slidable passage of a shuttle thereover and further configured to be coupled to the belay lines; and a first pair of anchor elements extending through two of said four first and second openings in said first mounting plate and first support plate, respectively, and into a vertical support to mount said first mounting plate and said first support plate to the vertical support; and a second pair of like configured anchor elements extending through a different two of said four first and second openings in said second mounting plate and second support plate, respectively, and into a vertical support to mount said second mounting plate and said second support plate to the vertical support.

12. The anchor system of claim 11, wherein said anchor elements include:

a threaded rod sized to extend through the mounting and support plates and the vertical support; and a pair of threaded nuts for threadedly engaging said threaded rod to clamp said support plate therebetween.

13. The anchor system of claim 11, further comprising third and fourth like configured support plates, each defining at least four second openings corresponding to said at least four first openings, said third support plate mated with said first support plate by said first pair of anchor elements and said fourth support plate mated with said second support plate by said second pair of anchor elements.

14. The anchor system of claim 13, further at least two tubes disposed between said two of said second openings in said first and third support plates and at least two like configured tubes disposed between said different two of said second openings in said second and fourth support plates, said tubes configured to receive said anchor elements therethrough.

15. The anchor system of claim 11, wherein said first and second like configured mounting plates include a central portion with said at least four first openings, and wing portions flanking said central portion.

16. The anchor system of claim 15, wherein said wing portions are oriented at a non-coplanar angle relative to said central portion so that said mounting plates have a generally concave shape corresponding to a cylindrical vertical support.

17. The anchor system of claim 15, wherein said wing portions define at least one slot for supporting an adjustable spacer with said spacer arranged to contact the vertical support when said mounting plate is mounted thereto.

18. The anchor system of claim 11, wherein a wing portion of said first mounting plate overlaps a wing portion of said second mounting plate when said anchor elements mount said mounting plates to the vertical support.

19. The anchor system of claim 18, wherein:

said wing portions define at least one slot for receiving an adjustable spacer with said spacer arranged to contact the vertical support when said mounting plate is mounted thereto; and the wing portions of said first and second mounting plates overlap with said slot in each wing portion aligned to receive said adjustable spacer therethrough.

20. A profile tip for a shuttle guide forming part of a fall protection system having belay lines connected between shuttle guides mounted to vertical supports and adapted to slidably receive a shuttle coupled to a person traversing the belay lines, said profile tip comprising:

an engagement end configured for removable engagement with an end of a shuttle guide opposite the end of the guide that is connected to the belay line;

a body extending from said engagement end; and a deflectable unidirectional element mounted to said body, said element configured to prevent passage of a shuttle over said body in one direction and deflectable to permit passage of the shuttle over said body in the opposite direction.

21. The profile tip of claim 20, wherein said element is a torsion spring having at least one arm projecting outward from said body, said torsion spring configured so that said arm deflects toward said body to permit passage of the shuttle.

22. The profile tip of claim 21, wherein said torsion spring includes a pair of arms, each projecting from opposite sides of said body and each configured to deflect towards each other to permit passage of the shuttle.

23. The profile tip of claim 22, wherein said body defines a slot and said torsion spring is anchored to said body within said slot.

24. A transfer station for a personal fall protection system having belay lines extending between vertical supports and adapted to slidably receive a shuttle coupled to a person traversing the belay lines, the transfer station comprising:

a mounting plate and anchor elements configured to fasten said mounting plate to the vertical support;

at least two shuttle guides carried by said mounting plate, each shuttle guide configured to slidably receive a shuttle thereon, one end of each of said shuttle guides being connectable to a different belay line terminating at the transfer station;

a transfer shuttle guide configured to slidably receive a shuttle thereon, said transfer shuttle guide rotatably supported on said mounting plate so that said transfer shuttle guide may be rotated into alignment with any of said at least two shuttle guides for passage of a shuttle therebetween.

25. The transfer station of claim 24, wherein:

one of said at least two shuttle guides is fastened to said mounting plate generally tangential to the vertical support;

another of said at least two shuttle guides is supported substantially perpendicular to the vertical support; and said transfer shuttle guide is rotatably supported to be rotated into alignment said one or said another of said at least two shuttle guides.

26. The transfer station of claim 24, wherein:

said mounting plate includes side wings, each of said side wings including one of said at least two shuttle guides mounted thereto; and said transfer shuttle guide is rotatably supported to be rotated into alignment with the shuttle guide on either of said side wings.

27. The transfer station of claim 26, wherein:

a third one of said at least two shuttle guides is supported substantially perpendicular to the vertical support; and said transfer shuttle guide is rotatably supported to be rotated into alignment said any one of said at least two shuttle guides.

28. A transfer station for a personal fall protection system having belay lines extending between vertical supports and adapted to slidably receive a shuttle coupled to a person traversing the belay lines, the transfer station comprising:

a mounting element for mounting at least two shuttle guides on a vertical support;

a guide beam supported by said mounting element and configured to encircle the vertical support;

at least two shuttle guides carried by said mounting element, each shuttle guide configured to slidably receive a shuttle thereon, one end of each of said shuttle guides being connectable to a different belay line terminating at the transfer station and the opposite end of each of said shuttle guides being accessible inboard of said guide beam;

a transfer ring configured to encircle the vertical support and slidably supported by said guide beam between said guide beam and the vertical support so that said transfer ring may be rotated relative to the vertical support; and at least one shuttle peg mounted on said transfer ring and configured to slidably receive a shuttle thereon, said at least one shuttle peg rotatable with said transfer ring so for alignment with any of said at least two shuttle guides for passage of a shuttle therebetween, wherein said guide beam is an I-beam having a lower web configured to support an outboard portion of said transfer ring.

* * * * *